US005480513A

United States Patent [19]

Niskanen et al.

[11] Patent Number: 5,480,513

[45] Date of Patent: Jan. 2, 1996

[54] METHOD AND DEVICE FOR CONTROLLING A WIRE IN A FORMING GAP OF A WEB FORMER

[75] Inventors: Juhani Niskanen, Oulunsalo; Michael Odell, Jyväskylä, both of Finland

[73] Assignee: Valmet Paper Machinery Inc., Helsinki, Finland

[21] Appl. No.: 164,134

[22] Filed: Dec. 8, 1993

[30] Foreign Application Priority Data

Dec. 8, 1992 [FI] Finland ..... 925579

[51] Int. Cl.[6] ..... D21F 1/00

[52] U.S. Cl. ..... 162/203; 162/256; 162/273; 162/301

[58] Field of Search ..... 162/203, 300, 162/301, 273, 252, 256

[56] References Cited

U.S. PATENT DOCUMENTS

| | | | |
|---|---|---|---|
| 3,440,136 | 4/1969 | Nelson et al. | 162/275 |
| 4,925,531 | 5/1990 | Koski | 162/301 |
| 5,084,138 | 1/1992 | Ewald | 162/300 |
| 5,252,186 | 10/1993 | Sollinger et al. | 162/301 |

FOREIGN PATENT DOCUMENTS

| | | |
|---|---|---|
| 2061517 | 8/1992 | Canada . |
| 86752 | 4/1991 | Finland . |
| 84735 | 9/1991 | Finland . |
| 920500 | 2/1992 | Finland . |
| 9007025 | 10/1990 | Germany . |
| 304168 | 6/1961 | Sweden . |
| 2073798 | 10/1981 | United Kingdom . |

*Primary Examiner*—Karen M. Hastings
*Attorney, Agent, or Firm*—Steinberg, Raskin & Davidson

[57] ABSTRACT

Method and device for controlling a wire in the forming gap of a twin-wire web former of a paper machine, which gap is defined between two opposite forming wires. A pulp suspension jet is fed out of the discharge opening of the headbox of the paper machine into the forming gap. The jet has a free flight distance before it meets the forming wires. In the area of the forming gap, a variable-crown or adjustable-crown breast roll is employed as the breast roll of at least one of the wires. The deflection of the mantle of this breast roll is regulated actively from inside the mantle of the breast roll. In this manner, the transverse tightness profile of the wire guided by the breast roll and/or possible instabilities of the wire is/are controlled in particular in the area of the forming gap.

20 Claims, 2 Drawing Sheets

METHOD AND DEVICE FOR CONTROLLING A WIRE IN A FORMING GAP OF A WEB FORMER

BACKGROUND OF THE INVENTION

The present invention relates to a method in the forming gap in a twin-wire web former of a paper machine, which gap is defined between two opposite forming wires. A pulp suspension jet is fed out of the discharge opening of the headbox of the paper machine into the forming gap. The pulp suspension jet has a certain free flight distance before it meets the forming wires.

The present invention also relates to a forming-gap arrangement in a twin-wire former of a paper machine, which arrangement includes a forming gap, into which a pulp suspension jet is fed out of a discharge opening of a headbox. The discharge opening is profiled in the transverse direction by means of a profile bar and a series of adjusting spindles acting upon the profile bar, and/or by equivalent means for adjusting the profile of the pulp suspension jet. The forming gap is defined between a first wire guided by the forming roll and a second wire guided by a breast roll situated opposite to the forming roll.

In prior art gap formers in paper machines, the pulp suspension jet is fed into a gap which is placed between the forming wires, a so-called forming gap, and becomes narrower, e.g., wedge-shaped in the flow direction of the suspension jet. In several gap formers, such as the formers marketed by the assignee under the trade mark "Speed Former HS"™, the pulp suspension jet is directed towards an unsupported outer wire at a certain angle of impingement. The live pulp suspension jet produces instability in the unsupported wire, and, even more so, transverse wrinkles, wave formation and streaks at the edges of the web. This tendency to cause wrinkles and form waves produces variation in grammage both in the machine direction and in the transverse direction in the finished paper or board produced by the paper machine.

In gap forming techniques, the flight distance of the pulp suspension jet departing from the headbox is considered a critical factor in several respects. The relatively long flight distance of the jet subjects the jet to the effects of air flows in the gap, whereby the point of impingement of the jet may change and/or the face of the jet may be disintegrated. This results in a deterioration of the formation, and possibly also other properties, of the paper. In the absence of turbulence arising from differences in velocity produced by walls, the long flight distance of the jet also increases the re-flocculation of the fibers and causes a detrimental extent. Flocculation being the aggregation and coalescence of the pulp fibers into small lumps or loose clusters.

In typical prior art gap formers, two opposite forming rolls are utilized and are arranged inside the two wire loops to operate as breast rolls thereby forming a gap. Alternatively, one forming roll is used in the gap area and is placed inside the loop of the inner wire. The outer wire is passed into contact with the roll by means of a reversing roll or breast roll. Owing to the large-diameter breast rolls and forming rolls and owing to the guide rolls, the geometry of the forming gap usually becomes such that it is difficult to place the discharge opening of the headbox deep enough inside the forming gap, e.g., because the regulation means of the profile bar at the discharge opening require a considerably large amount of space.

A prior art solution to this problem is to shorten the flight distance of the discharge jet of the headbox by means of various stationary "turning bar" constructions, whereby the wire can be made to pass closer to the starting point of the jet. An example of this type of prior art construction is the forming-gap arrangement described in the assignee's Finnish Patent No. 86,752, in which, besides a "turning bar" an oblong stabilization bar is arranged inside the loop of the outer wire in the area of the bottom of the forming gap. The oblong stabilization bar stabilizes the run of the outer wire in the area of the bottom of the forming gap and removes water through the outer wire.

In conventional headboxes for gap formers, there is a precisely machined profile bar for the ultimate smoothing of the pulp jet and for the control of the grammage profile. The thickness of the pulp flow, i.e., the grammage profile of the paper web, is controlled, in a manner known in prior art, by bending the profile bar by means of spindles. As stated above, these regulation means, i.e., spindles, are large devices and prevent positioning of the lips of the headbox as deep as desired in the forming gap itself. Thus, in the prior art gap formers, the free jet length is limited in a range from about 200 mm to about 300 mm, depending on the width of the machine and on the diameter of the forming and breast rolls.

In view of solving these problems, in the assignee's Finnish Patent No. 84,735, a method is described in which the thickness profile of the pulp suspension jet in the transverse direction is regulated by profiling the mantle of at least one breast roll arranged inside the forming wire in the area of the forming gap. The forming-gap arrangement of FI 84,735 comprises at least one adjustable-crown breast roll and a series of hydraulic loading members arranged in the interior of the breast roll in the area of the forming gap. The hydraulic loading members are arranged to be loaded by hydraulic pressure. The adjustable-crown breast roll is arranged to shape the forming gap in a manner such that, by regulating the deflection of its mantle, the transverse thickness profile of the pulp suspension jet fed into the forming gap can be controlled.

In the prior art forming-gap arrangements of twin-wire formers, generally a so-called "roll supported at the middle" (hereinafter referred to as a mid-support roll) is used as the reversing roll or breast roll placed opposite to the former roll. In this position, the mid-support rolls create a number of different problems, of which the unfavorably large length of the discharge jet arising from the large diameter of the mid-support roll, was already discussed above. Second, the form of deflection of the mid-support roll is unfavorable. For this reason, the run of the wire guided by the mid-support roll is unstable and poorly controllable, especially across a width of about 1 meters to about 2 meters at the edges of the wire. This results from the relative difference between the deflection lines of the outer mantle of the mid-support roll and of the other rolls in the wire circulation.

The use of the mid-support roll as a breast roll restricts the setting of the tension of the forming wire guided by the mid-support roll. The tension of the wire and the variation of the tension in the transverse direction affects the draining of water in the twin-wire zone. At present, the operation takes place in a wire-tension range of from about 5 kN/m to about 8 kN/m, but a need has arisen to raise the level of wire tension. It is estimated that in the future it will be necessary to employ a tension range of about 10 kN/m to about 12 kN/m. One object of the present invention is also to permit web former operations with such increased wire-tension.

The problems discussed above have also been discussed in Finnish Patent Application No. FI 920500 (corresponding to German Patent Application No. DE 41 05 215.3 and Canadian Patent Application No. 2,061,517) to Messrs. J. M. Voith GmbH. In FI 920500, a device is described in which one or both of the breast rolls of the twin-wire former are supported by means of a hydrostatic pressure bearing arranged externally in relation to the roll. This arrangement is, however, unfavorable both in view of the construction and in view of the operation, among other things, because the upper breast roll requires specific support means. Another disadvantage arises because the hydrostatic pressure bearing is placed on an upper sector of the roll, in which case the weight of the roll is supported by wire tensioning forces only.

OBJECTS AND SUMMARY OF THE INVENTION

Accordingly, it is an object of the present invention to avoid the drawbacks of the prior art gap former arrangements mentioned above.

It is another object of the present invention to provide a new and improved method and device for controlling a transverse tightness profile of a wire guided by a breast roll forming one side of the gap and/or possible instabilities of the wire by regulating the deflection of the mantle of the breast roll from an interior of the mantle.

It is another object of the present invention to provide a new and improved gap former arrangement in which it is possible to control a wire used in the forming gap and employ a tension range of about 10 kN/m to about 12 kN/m in the forming wire guided by a mid-support roll.

In order to achieve the objects stated above, and others, the present invention includes a variable-crown or adjustable-crown breast roll employed in the area of the forming gap as the breast roll of at least one of the wires which define the forming gap. The deflection of the mantle of the breast roll is regulated actively from inside the mantle of the breast roll. This regulation serves to control the transverse tightness profile of the wire guided by the breast roll and/or possible instabilities of the wire, in particular in the area of the forming gap.

The forming-gap arrangement in accordance with the invention includes a breast roll which is a relatively slim, variable-crown or adjustable-crown breast roll and in which the deflection of its revolving mantle is controlled by means of hydraulic loading members arranged inside the mantle. The transverse tightness profile and/or the instability of the wire that runs over the breast roll are controllable by means of interior regulation of the deflection of the mantle.

In the present invention, the deflection of the mantle of the variable-crown or adjustable-crown breast roll is regulated from inside, i.e., from its interior, and controlled actively by means of the setting or regulation of the hydraulic pressure in the hydraulic loading members of the roll. In this manner, the transverse tension profile and/or the instability of the wire that runs over the variable-crown breast roll is/are controlled. This type of control was not possible when, in prior art arrangements, a mid-support roll was used as the breast roll whose deflection was mainly minimized by means of a certain wire tension.

The problems discussed above, and others, are resolved in the present invention by using a variable-crown roll as the breast roll at the forming gap instead of a mid-support roll. In the present invention, unlike the arrangement described in FI Patent 84,735 mentioned above, the variable-crown roll is used preferably so that the deflection to be adjusted is substantially parallel to the plane of the pulp suspension jet. In this manner, the regulation of the deflection of the variable-crown roll does not have a significant effect on the thickness profile of the web, nor is it supposed to be substituted for the profile bar that profiles the discharge opening of the headbox.

In a variable-crown breast roll placed in accordance with the present invention in a forming gap, an adjustment in zones is not necessarily needed. The load produced by the tension of the wire guided by the variable-crown breast roll is rather low, so that the diameter of the variable-crown roll can be dimensioned to be quite small. For example, the outer diameter of a variable-crown breast roll in a paper machine having a width of from about 9 meters to about 10 meters is typically about 700 mm. In the interior of the variable-crown roll, just a few hydrostatic glide shoes are required, and, depending on their number, their pressure also remains low. In such an arrangement, the hydraulic central unit is small and has a corresponding low cost, which is an advantage over the prior art devices. The variable-crown breast roll may be connected to lubrication circulation means. The variable-crown breast roll does not require complicated supervision systems, which is normally the case with rolls adjustable in zones thereof.

It is a significant principle in the field of the present invention that the shorter the free discharge jet of pulp suspension is, the better, i.e., a shorter free flight distance of the pulp suspension jet improves the results and reduce re-flocculation. In prior art constructions in wide machines, the length of the jet is generally about 300 mm. However, a practical optimal length is in the range of about 100 mm. By means of the present invention, a jet length of from about 150 mm to about 250 mm can be achieved even with wide machines, which is equal to the jet length of existing narrow machines.

The variable-crown roll applied in the present invention is constructed to be relatively slim and has a diameter as small as possible. However, owing to limitations of the construction of such variable-crown rolls, it is nearly impossible to use diameters smaller than a certain minimum diameter, because there are limiting factors, such as the tools for the manufacture and the difficulties in the control of the precision of manufacture of a very thin roll, and the oscillations and strength of a thin roll. It is a criteria of the dimensioning of the minimum diameter of a variable-crown roll placed in a position in accordance with the invention that the variable-crown roll must tolerate running even with maximum wire tensions and also when not pressurized. As the wire tensions will be undoubtedly be higher in the future and in planned gap formers, it is already an advantage provided by the present invention that the diameter of the breast roll in the area of the forming gap can be kept substantially unchanged. According to the present invention, it is possible to provide a variable-crown breast roll whose diameter, even in the widest paper machines, is of an order of less than about 700 mm.

In the method for controlling a wire in a forming gap of a twin-wire web former of a paper machine, the forming gap is defined by first and second forming wires. A pulp suspension jet is fed out of a discharge opening of a headbox of the paper machine and into the forming gap. The jet having a free flight distance before it contacts the forming wires. In accordance with the invention, a variable-crown or adjustable-crown breast roll is arranged in a loop of the first wire in proximity to the forming gap. The breast roll has a revolving mantle having an interior. The deflection of the mantle of the breast roll is regulated from an interior of the mantle to control at least one of the transverse tightness profile of the first wire and instabilities of the first wire. In order to regulate the deflection of the mantle of the breast roll, the mantle is preferably loaded, e.g., by hydraulic loading members, in a direction which is substantially equal (parallel) to a direction of a plane of the pulp suspension jet fed into the forming gap.

Further, a web forming roll is arranged in a loop of the second forming wire to guide the second wire. The web forming roll is arranged opposite the breast roll and has a diameter substantially larger than the diameter of the breast roll. The flight distance of the pulp suspension jet is reduced by arranging the discharge opening of the headbox inside the forming gap.

The device for controlling a wire in a forming-gap arrangement of a twin-wire former in a paper machine, includes a forming roll, a variable-crown or adjustable-crown breast roll arranged opposite the forming roll. The breast roll has a revolving mantle. A forming gap is defined by a first wire guided by the forming roll and a second wire guided by the breast roll. A pulp suspension jet is fed out of a discharge opening of a headbox into the forming gap. In accordance with the invention, loading means are arranged in an interior of the mantle of the breast roll to control the deflection of the mantle and regulate at least one of a transverse tightness profile and the instability of the second wire that runs over the breast roll.

In a preferred embodiment, the device includes means for profiling the discharge opening in a transverse direction, e.g., a profile bar and a series of adjusting spindles acting upon the profile bar, or adjustment means for adjusting the profile of the pulp suspension jet. The breast roll has a stationary central axle and glide shoes arranging therein. The glide shoes act upon an inner face of the mantle of the breast roll substantially in a direction of a plane of the pulp suspension jet fed into the forming gap. The glide shoes may be arranged symmetrically in an axial plane of the breast roll at both sides of a vertical center plane of the breast roll and preferably uniformly spaced in the machine direction.

The loading means are preferably pistons arranged in cylinders formed in the axle of the breast roll and a pressure-medium duct connected to the cylinders. An adjustable hydraulic pressure is passed along the pressure-medium duct into the cylinders to load the glide shoes.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
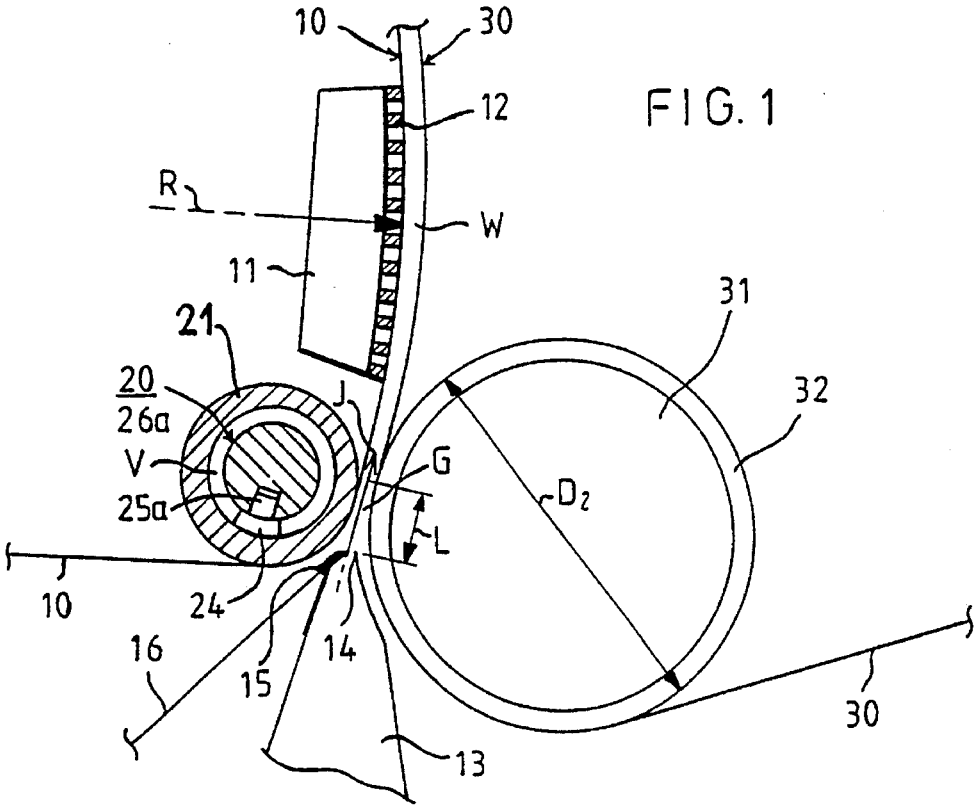
FIG. 1 shows a typical forming-gap arrangement in accordance with the present invention in a twin-wire former.

Accordingly, FIG. 1 shows a forming-gap arrangement in accordance with the present invention, which comprises a forming gap G defined between a pair of forming wires 10 and 30 and narrowing, e.g., wedge-shaped, in the running direction of the wires. A pulp suspension jet J is fed out of the discharge opening 14 of the headbox 13 and into the gap G. The transverse thickness profile of the pulp suspension jet J is regulated by means of a profile bar 15, whose profile is controlled by means of a series of adjusting spindles 16, or other equivalent regulating and/or adjusting means. The forming gap G is defined between a first wire 10, which is guided by a small-diameter ($D_1$<about 700 mm) variable-crown roll 20 that operates as a breast roll, and a second wire 30 guided by a forming roll 31. After the gap G, a twin-wire forming zone starts, which may be curved (as shown) and guided by a forming shoe 11 with ribbed deck 12 having a large curve radius R toward the variable-crown breast roll 20. However, the twin-wire forming zone may be straight, vertical, horizontal or otherwise. In the embodiment wherein the twin wire zone is straight, the forming shoe 11 may be removed. Alternatively, the forming shoe 11 may curve in an opposite direction to the direction of curvature of the breast roll 20.

In FIG. 1, for the sake of simplicity, the complete runs of the wire loops 10 and 30 are not shown. Guide rolls (not shown) may be arranged in the interior of the run of the loop of wire 10 for guiding the first wire loop 10. The guide rolls may include a tensioning roll so that the necessary wire tension of wire 10 is produced by means of power units acting upon the axle journals of the tensioning roll. The transverse profile of the wire tension is adjusted by means of the variable-crown breast roll 20 arranged in accordance with the present invention.

The breast roll that is used is a relatively slim or thin variable-crown roll 20 having a hollow face 32 and whose diameter $D_1$ is dimensioned to be substantially smaller than that of prior art variable-crown breast rolls. The diameter $D_1$ of the variable-crown breast roll 20 is generally less than about 700 mm. The diameter $D_2$ of the forming roll 31 that is placed opposite the hollow-faced 32 variable-crown breast roll 20 is typically about 1600 mm. In a preferred embodiment of the invention, the diameter $D_2$ of the forming roll 31 placed opposite the variable-crown breast roll 20 is substantially larger than the diameter $D_1$ of the variable-crown breast roll 20, preferably $D_2$ is about $(2–2.3)\times D_1$. Owing to the small diameter $D_1$ of the variable-crown roll 20, the slice cone of the headbox 13 and the slice opening 14 placed at the end of the cone can be extended deeper into the forming gap G so that the free flight distance L of the discharge jet J in the gap G remains shorter than in prior art gap formers. Typically, in the present invention, the free flight distance L of the discharge jet J is in a range of about 150 mm to about 250 mm, even in the widest machines wherein the width of the rolls is from about 8 to about 10 meters in diameter.

Figure 3:
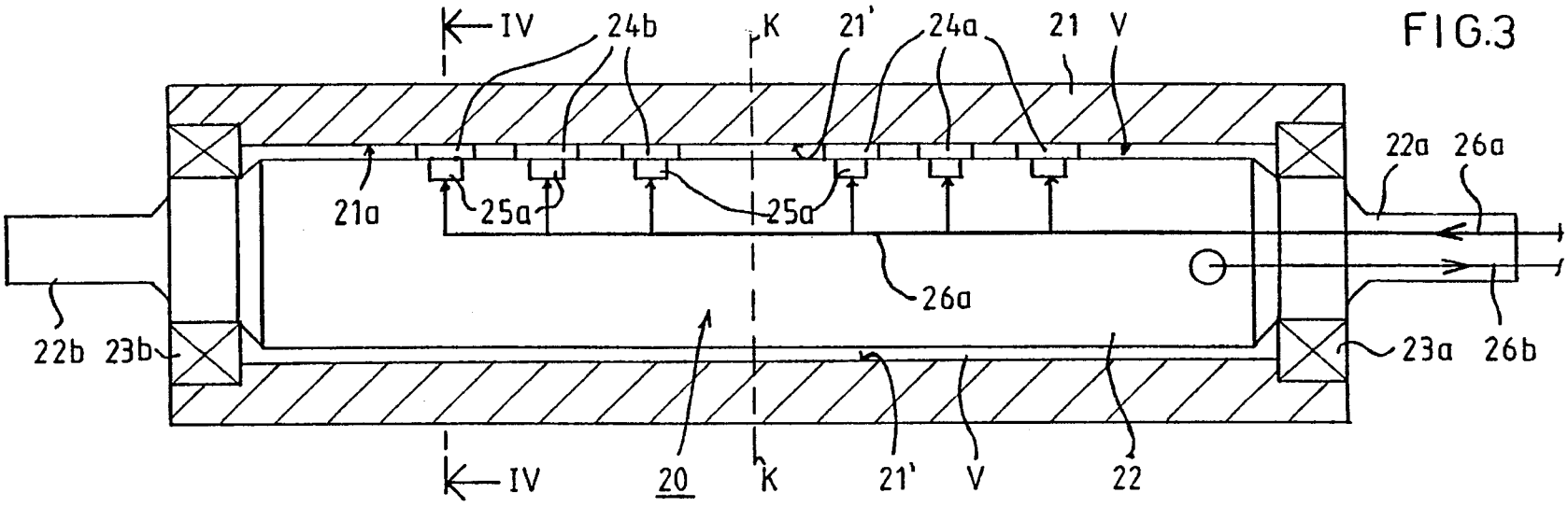
FIG. 3 is a central axial sectional view of a variable-crown roll in accordance with the present invention and used in the method of the present invention.
Figure 6:
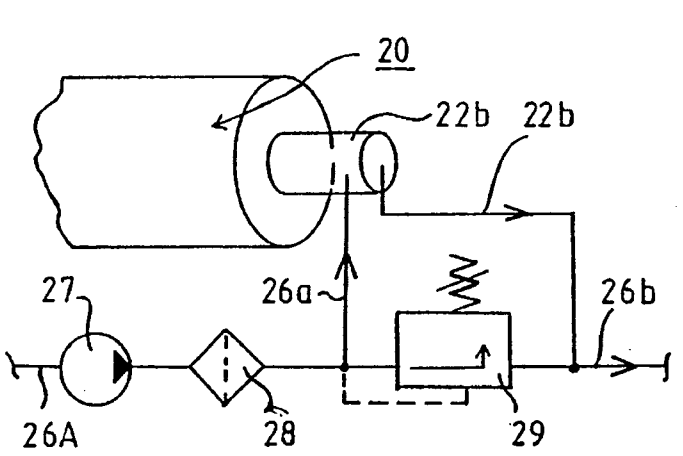
FIG. 6 is a schematic illustration of the hydraulic central unit for a variable-crown roll in accordance with the present invention.
Figure 5:
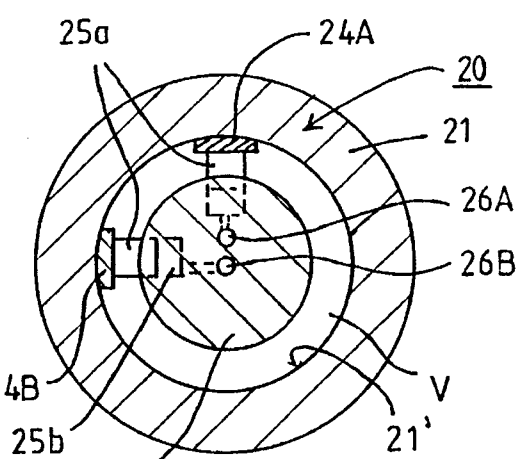
FIG. 5 shows an alternative embodiment of the present invention in a manner corresponding to FIG. 4.
Figure 4:
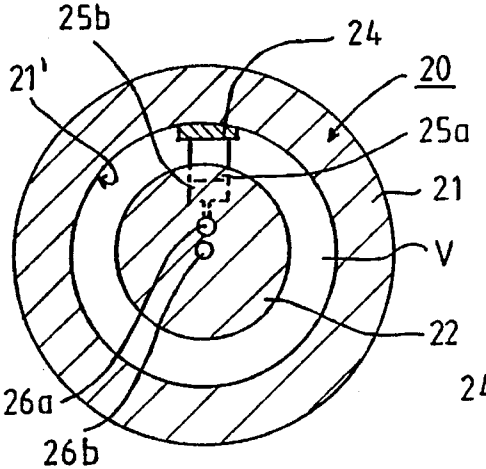
FIG. 4 is a sectional view taken along the line IV—IV in FIG. 3.

As shown in FIGS. 3, 4 and 5, the variable-crown breast roll 20 has a stationary massive central axle 22 which is supported from its axle journals **22*a* and 22*b*. On the central axle 22, a revolving roll mantle 21 is mounted by means of end bearings 23*a* and 23*b*. In the interior of mantle 21, there are hydraulically loaded glide shoes 24 which operate against the smooth inner face 21' of the roll mantle. The glide shoes 24 are loaded against the smooth inner face 21' of the mantle 21 by pistons 25*a* arranged in cylinder bores 25*b* in the axle 22. A pressure medium is passed into the cylinder bores 25b through a pipe or bore 26a. The pressure medium is preferably hydraulic fluid. The fluid for loading the pistons 25a preferably also lubricates the glide faces of the shoes 24. The fluid is collected from the space V between the mantle 21 and the axle 22 and is passed through a return line 26b to the fluid circulation and to the hydraulic central unit, which is illustrated in FIG. 6**.

By means of the hydraulic pressure or pressures that load the glide shoes 24 in the variable-crown breast roll 20, the deflection of the roll mantle 21 is adjusted from its interior so that a desired transverse tension profile of the wire 10, usually a uniform profile, is obtained and/or that possible instabilities of the wire, in particular in the area of the forming gap G, can be brought under control. Thus, in the present invention, a new active regulation parameter or parameters has/have been taken into use, by whose means the tension profile and/or instability of the wire can be controlled.

Referring to FIG. 3, the glide shoes 24 are arranged in two groups 24a and 24b of three shoes, which groups are arranged symmetrically on both sides of a vertical center plane K—K of the variable-crown roll 20. In the groups 24a and 24b, the glide shoes 24 are arranged preferably to be uniformly spaced and placed in such a way that an adjustable deflection form, which is optimal in view of the regulation of the transverse profile of the wire 10 tension, is obtained for the mantle 21 of the variable-crown roll 20.

Figure 2:
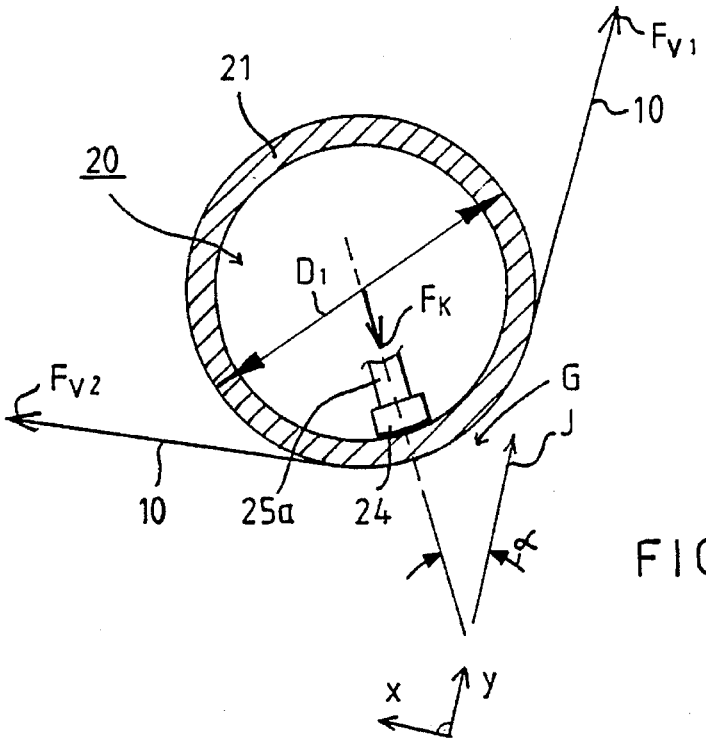
FIG. 2 illustrates the loading forces applied to a variable-crown breast roll in accordance with the present invention and the directions of the loading forces in comparison to the principal direction of the plane of the discharge jet J.

Referring to FIGS. 3 and 4, in the variable-crown roll 20, the groups 24a and 24b of the glide shoes are placed in one central axial plane in the variable-crown roll 20. The direction of the central axial plane is substantially equal to the direction of the plane of the pulp suspension jet J, or at a small angle (angle $\alpha$ as shown in FIG. 2) in relation to the direction of the plane of the pulp suspension jet J. In the case that the direction of the axial plane is substantially equal to the direction of the plane of the pulp suspension jet J, the glide shoes would operate parallel to the direction of the pulp suspension jet but the flow direction of the pulp suspension jet J would be opposite to the direction of the loading force $F_k$.

Although three glide shoes are shown in each group in the embodiment of FIG. 3, it is understood that the amount of glide shoes in each group and the number of different groups can vary as desired.

Referring to FIG. 5, an alternative embodiment of the present invention is shown in which two series 24A and 24B of glide shoes are arranged in the interior of the mantle 21 of the variable-crown roll 20. The variable-crown roll 20 as shown in FIG. 5 is placed as a breast roll in the forming gap preferably so that the shoes in the first group of glide shoes 24A act in the plane of the pulp suspension jet J, and the shoes in the second group of glide shoes 24B act in the direction perpendicular to that direction, toward the forming gap. In the group 24A, there are preferably about 1 to about 4 separate loading zones, and in the second group 24B there are preferably about 1 to about 8 separate loading zones. The series of glide shoes 24A and 24B are loaded, e.g., by means of separately adjustable hydraulic pressures, for which purpose the pressure medium is passed into the cylinders 25b through separate pipes or bores 26A and 26B. By independently regulating the series of glide shoes 24A and 24B that act upon the deflection of the mantle 21 in directions perpendicular to one another, it is possible to affect the magnitude and the direction of their resultant load so that the deflection of the mantle 21 of the variable-crown breast roll 20 can always be adjusted so that it is optimal in view of the transverse tension profile of the wire 10. Although only two groups of glide shoes are shown, it is understood that the number of different groups can be selected as desired.

In the following, mainly with reference to FIG. 2, the directions and forces of loading of the variable-crown breast roll 20 placed in a position in accordance with the present invention will be described.

The direction of the loading forces $F_k$ applied by the glide shoes 24 inside the variable-crown breast roll 20 may differ from the direction of the plane of the discharge jet J. This deviation produces a component which acts upon the profile of the discharge jet J and which must be taken into account. The magnitude of this component is $t_s$–sin $\alpha$·t, wherein t is the total deflection of the roll 20, $\alpha$ is the angle of deviation, and $t_s$ is the component perpendicular to the discharge jet J.

The component perpendicular to the discharge jet J can be utilized, if it is necessary and otherwise appropriate, in accordance with the invention described in FI Patent 84,735 mentioned above. If it is not desirable to act upon the profile of the discharge jet J at the same time as the variable-crown breast roll 20 is adjusted, the direction of the forces $F_k$ must coincide with the bisector of the wire 10 tensioning directions (forces $F_{v1}$ and $F_{v2}$).

The angle $\alpha$ shown in FIG. 2 should preferably be chosen such that the joint component parallel to the x axis of the wire forces $F_{v1}$ and $F_{v2}$ is equal to the component $F_{kx}$ parallel to the x axis of the inside loading force $F_k$. Thus, the optimal direction of the angle $\alpha$ depends on the type of the deflection that is desired in the direction y, which is the direction of the plane of the discharge jet J. By varying the levels and the ratio of the hydraulic loading forces of the series of glide shoes 24A and 24B as shown in FIG. 5, it is possible to regulate the direction and the magnitude of the resultant force $F_k$ of the glide shoes in a large variety of ways.

FIG. 6 is a schematic illustration of a hydraulic central unit connected to the variable-crown breast roll 20. The hydraulic unit forms a circulation system of lubrication having a supply line 26A in which the pressure of the lubricant is low. The increase of the pressure takes place by means of a hydraulic pump 27 to about 20 to 30 bar. A filter 28 is connected to the pressure side of the pump 27 and on an opposite side to a pressure regulator 29. From one side of the regulator, an inlet line 26a for pressure medium passes to the variable-crown roll 20. From the other side of the regulator, the return line 26B of the circulation-lubrication system starts. The return line 26b of the variable-crown roll 20 is connected to return line 26B.

In the present invention, the transverse tension profile of the wire 10 and/or possible instabilities of the wire 10 is/are controlled actively by means of inside or internal regulation of the deflection of the mantle 21 of the variable-crown breast roll 20, by whose means, if necessary, it is also possible, partly, to affect the draining profile in the transverse direction. By means of the hydraulic regulation of the deflection of the mantle 21 of the variable-crown roll taking place from inside the roll, at least the extent of deflection is influenced or, if necessary, even the shape of deflection is affected. In a preferred embodiment of the invention, regulation in zones proper of the glide shoes 24 is not needed, but the loadings of the glide shoes 24 are set at a certain set value, in which case the magnitude of the loading and of the total deflection of the mantle 21 can be regulated by adjusting the pressure level of the hydraulic fluid.

The examples provided above are not meant to be exclusive. Many other variations of the present invention would be obvious to those skilled in the art, and are contemplated to be within the scope of the appended claims.

We claim:

1. A method for controlling a wire in a forming gap of a twin-wire web former of a paper machine, which gap is defined between first and second forming wires, a pulp suspension jet being fed in a discharge direction out of a discharge opening of a headbox of the paper machine and into the forming gap, said jet having a free flight distance before it contacts the first and second forming wires, comprising the steps of:

arranging a variable-crown or adjustable-crown breast roll in a loop of the first wire opposite a forming roll arranged in a loop of the second wire in proximity to the forming gap, loading a revolving mantle of said breast roll in a first direction substantially parallel to the discharge direction in which the pulp suspension jet is fed from the discharge opening of the headbox into the forming gap, and adjusting the loading of the mantle to regulate the deflection of the mantle of said breast roll and control at least one of the transverse tightness profile of the first wire and instabilities of the first wire.

2. The method of claim 1, further comprising the step of fixedly mounting hydraulic loading members in said breast roll to load the mantle in a plurality of discrete locations from an interior thereof along an axis of said breast roll and adjusting the loading of the mantle at said plurality of discrete locations.

3. The method of claim 1, further comprising the step of controlling the transverse tightness profile of the first wire and/or instabilities of the first wire by adjusting the loading of the mantle at a position in which the first wire does not define the forming gap.

4. The method of claim 1, wherein said forming roll has a diameter substantially larger than the diameter of said breast roll, further comprising the step of arranging the discharge opening of the headbox inside the forming gap to reduce the flight distance of the pulp suspension jet.

5. The method of claim 4, further comprising the step of selecting the diameters of said forming roll and said breast roll such that the diameter of said forming roll is about twice the diameter of said breast roll.

6. The method of claim 1, wherein the loading step comprises the step of arranging two series of hydraulic glide shoes to apply a load in different directions from one another and feeding independently adjustable loading pressures into each of said two series of glide shoes.

7. The method of claim 6, further comprising the step of arranging a first one of said series of glide shoes to apply the load in the first direction and arranging a second one of said series of glide shoes to apply a load in a second direction substantially perpendicular to said first direction.

8. A device for controlling a wire in a forming-gap arrangement of a twin-wire web former in a paper machine, the web former including a headbox having a discharge opening from which a pulp suspension jet is discharged in a discharge direction, comprising a forming roll, a variable-crown or adjustable-crown breast roll arranged directly opposite said forming roll, said breast roll having a revolving mantle, a forming gap being defined between a first wire guided by said breast roll and a second wire guided by said forming roll, the pulp suspension jet being fed out of the discharge opening of the headbox into said forming gap, loading means arranged in an interior of said mantle of said breast roll for loading said mantle of said breast roll in a first direction substantially parallel to the discharge direction which the pulp suspension jet is fed from the discharge opening of the headbox into the forming gap, and regulation means for controlling at least one of a transverse tightness profile and the instability of the first wire that runs over said breast roll, said regulation means being coupled to said loading means and adjusting the loading provided by said loading means to control the deflection of said mantle such that at least one of the transverse tightness profile and the instability of the first wire that runs over said breast roll is controlled.

9. The arrangement of claim 8, further comprising means for profiling said discharge opening in a transverse direction, said means comprising a profile bar and a series of adjusting spindles acting upon the profile bar, or adjustment means for adjusting the profile of the pulp suspension jet.

10. The arrangement of claim 8, wherein said breast roll comprises a stationary central axle and said loading means comprise glide shoes arranged in a plurality of discrete locations along an axis of said breast roll and engaging with an inner surface of said mantle.

11. The arrangement of claim 8, wherein said breast roll has a diameter substantially less than the diameter of said web forming roll.

12. The arrangement of claim 11, wherein the diameter of said web forming roll is from about 2.0 to about 2.3 times the diameter of said breast roll.

13. The arrangement of claim 8, wherein the diameter of said breast roll is about 700 mm.

14. The arrangement of claim 8, wherein said breast roll comprises a stationary central axle and said loading means comprise a plurality of glide shoes engaging with an inner surface of said mantle, said glide shoes being symmetrically arranged in an axial plane of said breast roll at both sides of a vertical center plane of said breast roll.

15. The arrangement of claim 14, wherein said loading means further comprise a plurality of pistons arranged in cylinders and a pressure-medium duct connected to each of said cylinders, each of said pistons engaging with a respective one of said glide shoes, an adjustable hydraulic pressure being passed through said pressure-medium duct into said cylinders to load said glide shoes.

16. The arrangement of claim 14, wherein said glide shoes are uniformly spaced in the machine direction.

17. The arrangement of claim 8, wherein said loading means comprise two sets of glide shoes arranged in said breast roll to apply a load in different directions from one another, and means to pass hydraulic pressure through pressure-medium ducts to said two series of glide shoes, said means enabling an adjustable pressure to be passed independently into each of said two series of glide shoes.

18. The arrangement of claim 17, wherein a first one of said sets of glide shoes is arranged in the first direction substantially parallel to the direction in which the pulp suspension jet is fed from the discharge opening of the headbox into the forming gap, and a second one of said series of glide shoes is arranged in a second direction substantially perpendicular to the first direction.

19. A method for controlling a wire in a forming gap of a twin-wire web former of a paper machine, which gap is defined between first and second forming wires, a pulp suspension jet being fed out of a discharge opening of a headbox of the paper machine and into the forming gap, said jet having a free flight distance before it contacts the first and second forming wires, comprising the steps of:

arranging a variable-crown or adjustable-crown breast roll in a loop of the first wire opposite a forming roll arranged in a loop of the second wire in proximity to the forming gap, loading a revolving mantle of said breast roll over a sector of said breast roll over which the first wire runs and in advance of the pulp suspension jet being received on the first wire, adjusting the loading of the mantle to regulate the deflection of the mantle of said breast roll and control the transverse tightness profile of the first wire without affecting a thickness profile of the web.

20. The method of claim 19, wherein the mantle of said breast roll is loaded in a direction at an angle with respect to the direction of a plane of the pulp suspension jet.

* * * * *